US010030354B1

(12) United States Patent
Dean

(10) Patent No.: US 10,030,354 B1
(45) Date of Patent: Jul. 24, 2018

(54) ANTI-SPILL FOR LOADERS

(71) Applicant: CNH Industrial America, LLC, New Holland, PA (US)

(72) Inventor: Patrick Thomas Dean, Chicago, IL (US)

(73) Assignee: CNH Industrial America, LLC, New Holland, PA (US)

( * ) Notice: Subject to any disclaimer, the term of this patent is extended or adjusted under 35 U.S.C. 154(b) by 0 days.

(21) Appl. No.: 15/444,453

(22) Filed: Feb. 28, 2017

(51) Int. Cl.
*E02F 3/43* (2006.01)
*E02F 3/34* (2006.01)
*E02F 9/20* (2006.01)

(52) U.S. Cl.
CPC ..... *E02F 3/433* (2013.01); *E02F 3/3414* (2013.01); *E02F 9/2041* (2013.01)

(58) Field of Classification Search
CPC ..... E02F 3/433; E02F 3/3414; E02F 9/2041
See application file for complete search history.

(56) References Cited

U.S. PATENT DOCUMENTS 3,133,653 A 5/1964 Anderson
4,408,518 A * 10/1983 Diel ..... E02F 3/433 414/700
4,622,886 A 11/1986 Imada et al.
4,844,685 A 7/1989 Sagaser
4,923,326 A * 5/1990 Fietzke ..... F16D 1/0835 403/370
5,356,260 A * 10/1994 Ikari ..... E02F 3/433 414/700
6,233,511 B1 * 5/2001 Berger ..... E02F 3/432 414/699
6,609,315 B1 * 8/2003 Hendron ..... E02F 3/28 37/348
7,222,444 B2 * 5/2007 Hendron ..... E02F 3/432 172/239
7,530,185 B2 5/2009 Trifunovic
8,364,354 B2 * 1/2013 Pline ..... E02F 3/439 172/4.5
2004/0158355 A1 * 8/2004 Holmqvist ..... G05D 1/0236 700/245
2012/0321425 A1 12/2012 Shatters et al.

* cited by examiner

*Primary Examiner* — Russell Frejd
(74) *Attorney, Agent, or Firm* — Peter K. Zacharias

(57) ABSTRACT

The present disclosure is directed to a work vehicle such as a loader having a bucket attached to the lift arms of a lift assembly and including a system and method for controlling the operation of the lift assembly so as to enable the loader to move over varying terrain without spilling the contents of the bucket. The system includes a chassis sensor, a bucket sensor, a gravity sensor, and a control system for varying the position of the bucket. The system adjusts the bucket's orientation via the control system to maintain a 90 degree difference between the bucket vector and the gravity vector.

15 Claims, 6 Drawing Sheets

ANTI-SPILL FOR LOADERS

FIELD OF THE INVENTION

The present disclosure relates generally to work vehicles having a work implement that carries contents, and more particularly, to a system and method for controlling the orientation of the work implement as the vehicle moves over varying terrain.

BACKGROUND OF THE INVENTION

Work vehicles having lift assemblies, such as skid steer loaders, telescopic handlers, wheel loaders, backhoe loaders, forklifts, compact track loaders and the like, are a mainstay of construction work and industry. For example, skid steer loaders typically include a pair of loader arms pivotally coupled to the vehicle's chassis that can be raised and lowered at the operator's command. The loader arms typically have an implement attached to their end, thereby allowing the implement to be moved relative to the ground as the loader arms are raised and lowered. For example, a bucket is often coupled to the loader arm, which allows the skid steer loader to be used to carry supplies or particulate matter, such as gravel, sand, or dirt, around a worksite.

Control systems have been disclosed in the past having optional features that allows the operator to reset the loader arm(s) or implement to a predetermined height and orientation automatically via, e.g. joystick action or button press under the assumption that the work vehicle is on level terrain.

Unfortunately, when the operator executes such actions simultaneously while the work vehicle is negotiating terrain that is constantly varying between level terrain, ascending from level terrain or descending from level terrain, the implement circuit can fail to account for the effects of such terrain variations. Generally, if such varying terrain effects are sufficiently severe, then the implement can perform less than optimally such as occurs when the implement is a bucket that spills its contents due to the vehicle's chassis traversing uneven terrain.

Accordingly, an improved system and method for controlling the operation of a vehicle's lift assembly to allow the loader arms and the implement to be moved to a position simultaneously so as to counteract the implement performing contrary to its intended operation despite movement of the vehicle's chassis across uneven terrain, would be welcomed in the technology.

BRIEF DESCRIPTION OF THE INVENTION

Aspects and advantages of the invention will be set forth in part in the following description, or may be obvious from the description, or may be learned through practice of the invention.

In one aspect, the present disclosure is directed to a method for controlling the operation of a lift assembly of a work vehicle, wherein the lift assembly includes an implement and at least one loader arm coupled to the implement. The method may generally include maintaining the level disposition of the implement in a non-spill orientation relative to the gravity vector by adjusting the pitch of the implement commensurate with changes of the pitch of the chassis relative to the gravity vector as the work vehicle negotiates varying terrain wherein the pitch of the implement is determined relative to a vector associated therewith and similarly the pitch of the chassis is determined relative to a chassis vector associated with the orientation of the chassis relative to the gravity vector.

In another aspect, the present disclosure is directed to a work vehicle, wherein the lift assembly includes an implement and at least one loader arm coupled to the implement. The work vehicle includes a chassis defining a chassis vector. The work vehicle includes a gravity sensor carried by the chassis and configured to measure a gravity vector that defines the direction in which the gravitational force acts on the chassis. The work vehicle includes a chassis sensor carried by the chassis and configured to determine the orientation of the chassis vector relative to the gravity vector. The work vehicle includes a bucket carried by the chassis and pivotally mounted with respect to the chassis and defining a bucket vector. The work vehicle includes a bucket sensor carried by the chassis and configured to determine the orientation of the bucket vector relative to the gravity vector. The work vehicle includes a control system carried by the chassis and connected to the gravity sensor, the chassis sensor, and the bucket sensor. The control system is configured for adjusting the orientation of the bucket according to signals received from the gravity sensor, the chassis sensor, and the bucket sensor.

In yet another aspect, the present disclosure is directed to a method for controlling the operation of a lift assembly of a work vehicle, wherein the lift assembly includes an implement and at least one loader arm coupled to the implement. The method may generally include receiving, with a computing device, an input associated with an instruction to move the loader arm and the implement to a non-spill position. The method also includes transmitting, with the computing device, at least one first command signal in order to simultaneously move the loader arm and the implement towards the non-spill position. The steps of the method desirably are repeated with a frequency that depends upon the speed determined by a speed sensor that measures the speed with which the chassis is moving across the terrain being negotiated by the work vehicle.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
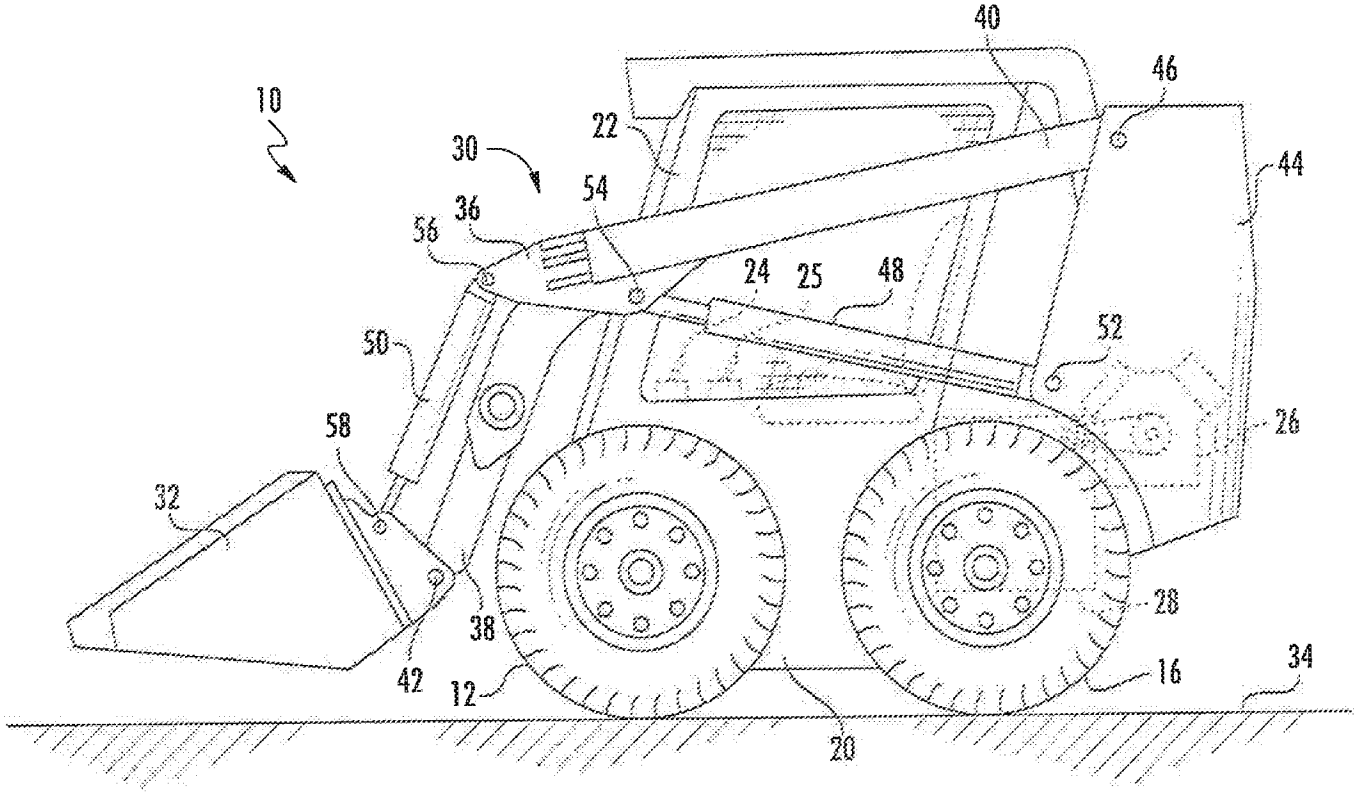
FIG. 1 illustrates a side view of one embodiment of a work vehicle according to the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Referring now to the drawings, FIG. 1 illustrates a side view of one embodiment of a work vehicle 10 in accordance with aspects of the present disclosure. As shown, the work vehicle 10 is configured as a skid steer loader. However, in other embodiments, the work vehicle 10 may be configured as any other suitable work vehicle known in the art, such as any other vehicle including a lift assembly that allows for the maneuvering of an implement (e.g., telescopic handlers, wheel loaders, backhoe loaders, forklifts, compact track loaders, bulldozers and/or the like).

As schematically shown in FIG. 1 for example, the work vehicle 10 includes a pair of front wheels 12, (one of which is shown), a pair of rear wheels 16 (one of which is shown) and a chassis 20 coupled to and supported by the wheels 12, 16. An operator's cab 22 may be supported by a portion of the chassis 20 and may house various input devices, such as one or more speed control joystick(s) 24 and one or more lift/tilt joystick(s) 25, for permitting an operator to control the operation of the work vehicle 10. A speed control joystick 24 and a lift/tilt joystick 25 are schematically shown in phantom by the dashed outlines in FIG. 1. In addition, the work vehicle 10 may include an engine 26 and a hydrostatic drive unit 28 coupled to or otherwise supported by the chassis 20 and shown in phantom by the dashed outlines in FIG. 1.

Moreover, as shown in FIG. 1, the work vehicle 10 may also include a lift assembly 30 for raising and lowering a suitable implement such as a bucket 32 relative to a driving surface 34 of the vehicle 10. In several embodiments, the lift assembly 30 may include at least one loader arm (such as a pair of loader arm(s)) 36 (one of which is shown) pivotally coupled between the chassis 20 and the implement 32. For example, as shown in illustrated embodiment of FIG. 1, each loader arm 36 may be configured to extend lengthwise between a forward end 38 and an aft end 40, with the forward end 38 being pivotally coupled to the implement 32 at a forward pivot point 42 and the aft end 40 being pivotally coupled to the chassis 20 (or a rear tower(s) 44 coupled to or otherwise supported by the chassis 20) at a rear pivot point 46.

In addition, the lift assembly 30 may also include a pair of hydraulic lift cylinders 48 coupled between the chassis 20 (e.g., at the rear tower(s) 44) and the loader arm(s) 36 and a pair of hydraulic tilt cylinders 50 coupled between the loader arm(s) 36 and the implement 32. For example, as shown in the illustrated embodiment, each lift cylinder 48 may be pivotally coupled to the chassis 20 at a lift pivot point 52 and may extend outwardly therefrom so to be coupled to its corresponding loader arm 36 at an intermediate attachment location 54 defined between the forward and aft ends 38, 40 of each loader arm 36. Similarly, each tilt cylinder 50 may be coupled to its corresponding loader arm 36 at a first attachment location 56 and may extend outwardly therefrom so as to be coupled to the implement 32 at a second attachment location 58.

It should be readily understood by those of ordinary skill in the art that the lift and tilt cylinders 48, 50 may be utilized to allow the implement 32 to be raised/lowered and/or pivoted relative to the driving surface 34 of the work vehicle 10. For example, the lift cylinders 48 may be extended and retracted in order to pivot the loader arm(s) 36 upward and downwards, respectively, about the rear pivot point 52, thereby at least partially controlling the vertical positioning of the implement 32 relative to the driving surface 34. Similarly, the tilt cylinders 50 may be extended and retracted in order to pivot the implement 32 relative to the loader arm(s) 36 about the forward pivot point 42, thereby controlling the tilt angle or orientation of the implement 32 relative to the driving surface 34. As will be described below, such control of the positioning and/or orientation of the various components of the lift assembly 30 may allow for the loader arm(s) 36 and/or the implement 32 to be moved to one or more pre-defined positions, such as a non-spill position, during operation of the work vehicle 10.

It should be appreciated that the configuration of the work vehicle 10 described above and shown in FIG. 1 is provided only to place the present disclosure in an exemplary field of use. Thus, it should be appreciated that the present disclosure may be readily adaptable to any manner of work vehicle configuration.

Figure 2:
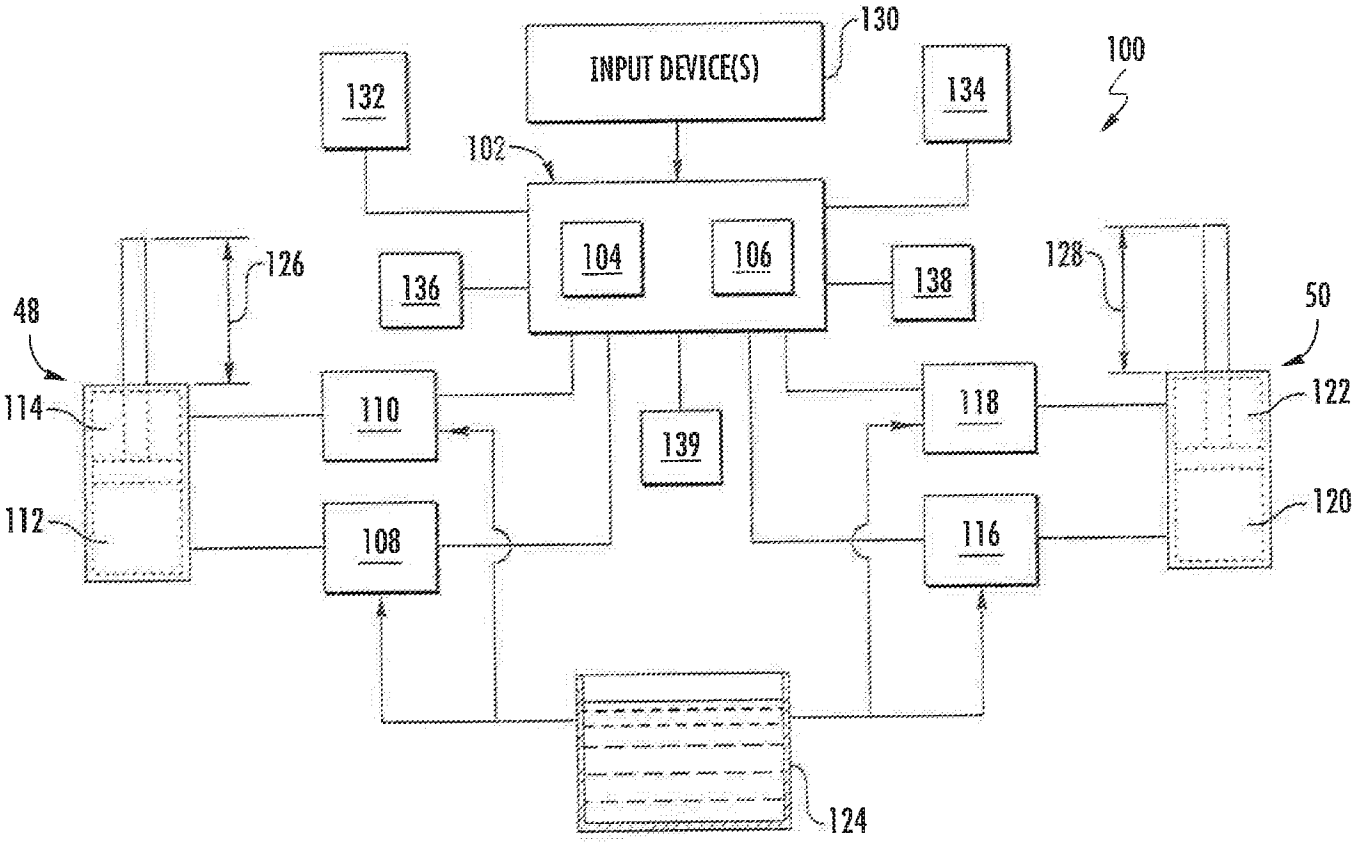
FIG. 2 illustrates a schematic view of one embodiment of a suitable control system for controlling various components of a work vehicle in accordance with aspects of the present disclosure, particularly illustrating the control system configured for sensing and controlling various hydraulic components of the work vehicle, such as the valves and associated hydraulic cylinders of the work vehicle and the spatial vectors associated with the chassis and the work implement.

Referring now to FIG. 2, one embodiment of a control system 100 suitable for controlling the various lift assembly components of a work vehicle 10 is illustrated in accordance with aspects of the present disclosure. In general, the control system 100 will be described herein with reference to the work vehicle 10 described above with reference to FIG. 1. However, it should be appreciated by those of ordinary skill in the art that the disclosed system 100 may generally be utilized to the control the lift assembly components of any suitable work vehicle.

As shown, the control system 100 may generally include a controller 102 configured to electronically control the operation of one or more components of the work vehicle 10, such as the various hydraulic components of the work vehicle 10 (e.g., the lift cylinders 48 and/or the tilt cylinders 50). In general, the controller 102 may include any suitable processor-based device known in the art, such as a computing device or any suitable combination of computing devices. Thus, in several embodiments, the controller 102 may include one or more processor(s) 104 and associated memory device(s) 106 configured to perform a variety of computer-implemented functions. As used herein, the term "processor" refers not only to integrated circuits referred to in the art as being included in a computer, but also refers to a controller, a microcontroller, a microcomputer, a programmable logic controller (PLC), an application specific integrated circuit, and other programmable circuits. Additionally, the memory device(s) 106 of the controller 102 may generally comprise memory element(s) including, but are not limited to, computer readable medium (e.g., random access memory (RAM)), computer readable non-volatile medium (e.g., a flash memory), a floppy disk, a compact disc-read only memory (CD-ROM), a magneto-optical disk (MOD), a digital versatile disc (DVD) and/or other suitable memory elements. Such memory device(s) 106 may generally be configured to store suitable computer-readable instructions that, when implemented by the processor(s) 104, configure the controller 102 to perform various computer-implemented functions, such as the algorithms or methods described below with reference to FIG. 5. In addition, the controller 102 may also include various other suitable components, such as a communications circuit or module, one or more input/output channels, a data/control bus and/or the like.

It should be appreciated that the controller 102 may correspond to an existing controller of the work vehicle 10 or the controller 102 may correspond to a separate processing device. For instance, in one embodiment, the controller 102 may form all or part of a separate plug-in module that may be installed within the work vehicle 10 to allow for the disclosed system and method to be implemented without requiring additional software to be uploaded onto existing control devices of the vehicle 10.

In several embodiments, the controller 102 may be configured to be coupled to suitable components for controlling the operation of the various cylinders 48, 50 of the work vehicle 10. For example, the controller 102 may be communicatively coupled to suitable valves 108, 110 (e.g., solenoid-activated valves) configured to control the supply of hydraulic fluid to each lift cylinder 48 (only one of which is shown in FIG. 2). Specifically, as shown in the illustrated embodiment, the system 100 may include a first lift valve 108 for regulating the supply of hydraulic fluid to a cap end 112 of each lift cylinder 48. In addition, the system 100 may include a second lift valve 110 for regulating the supply of hydraulic fluid to a rod end 114 of each lift cylinder 48. Moreover, the controller 102 may be communicatively coupled to suitable valves 116, 118 (e.g., solenoid-activated valves) configured to regulate the supply of hydraulic fluid to each tilt cylinder 50 (only one of which is shown in FIG. 2). For example, as shown in the illustrated embodiment, the system 100 may include a first tilt valve 116 for regulating the supply of hydraulic fluid to a cap end 120 of each tilt cylinder 50 and a second tilt valve 118 for regulating the supply of hydraulic fluid to a rod end 122 of each tilt cylinder 50.

During operation, the controller 102 may be configured to control the operation of each valve 108, 110, 116, 118 in order to control the flow of hydraulic fluid supplied to each of the cylinders 48, 50 from a suitable hydraulic tank 124 of the work vehicle 10 by operation of a hydraulic pump (not shown) that also is subject to being operated by the controller 102. For instance, the controller 102 may be configured to transmit suitable control commands to the pump and to the lift valves 108, 110 in order to regulate the flow of hydraulic fluid supplied to the cap and rod ends 112, 114 of each lift cylinder 48, thereby allowing for control of a stroke length 126 of the piston rod associated with each cylinder 48. Of course, similar control commands may be transmitted from the controller 102 to the pump and to the tilt valves 116, 118 in order to control a stroke length 128 of the tilt cylinders 50. Thus, by carefully controlling the actuation or stroke length 126, 128 of the lift and tilt cylinders 48, 50, the controller 102 may, in turn, be configured to control the manner in which the loader arm(s) 36 and the implement 32 are positioned or oriented relative to the vehicle's driving surface 34 and/or relative to any other suitable reference point.

Figure 3:
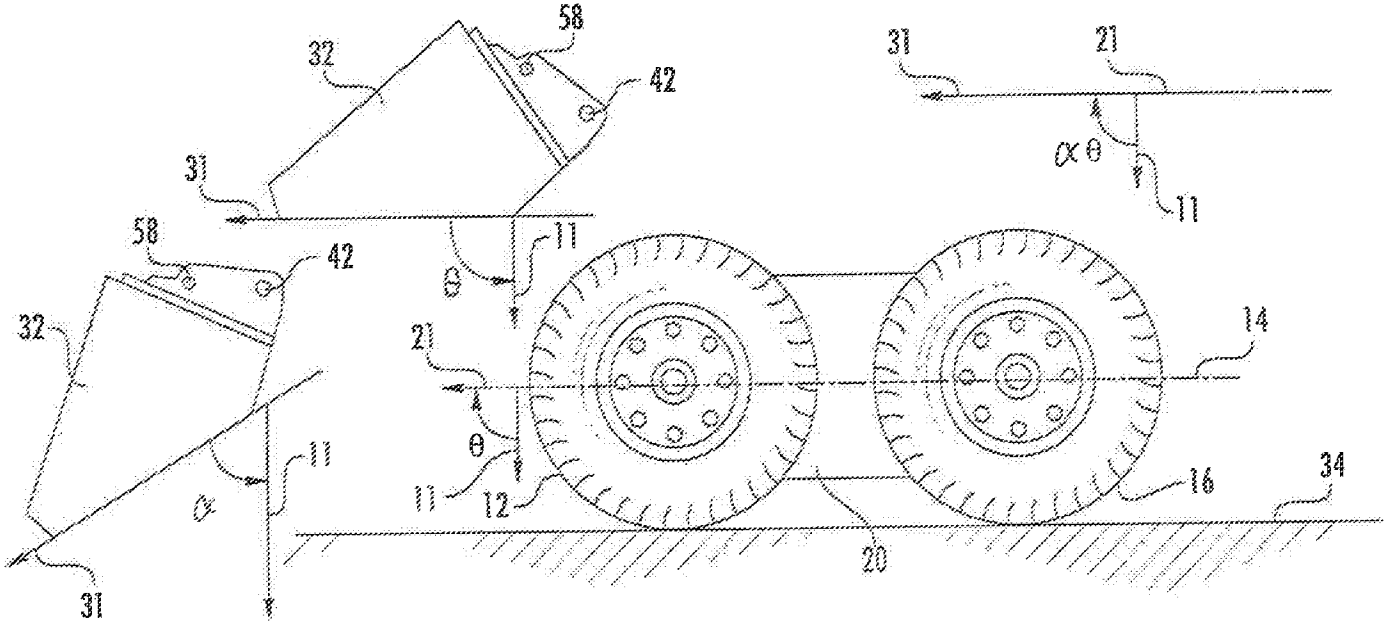
FIG. 3 schematically illustrates representations of the relative relationships between the orientation of the bucket and the orientation of the chassis relative to the gravity vector when the work vehicle is traveling on level ground with the bucket in the non-spill orientation and alternatively in the forward-spill (dumping) orientation.

Referring to FIG. 3, a schematic representation is presented to show the relative relationships between the disposition of the bucket 32 and the disposition of the chassis 20 relative to a gravity vector, which is indicated by the arrow designated 11. A chassis vector 21 is schematically represented in FIG. 3 and is parallel to the level of the terrain that underlies the chassis 20. Thus, the level of the terrain is deemed parallel to the center line 14 through the axles on which the wheels 12, 16 rotate and are carried by the chassis 20. Accordingly, the level of the terrain that constitutes the driving surface 34 of the work vehicle 10 is schematically indicated by the chain dashed line designated 14. A bucket vector is indicated by the arrow designated 31 in FIG. 3 and is arbitrarily chosen as a vector lying along the flat floor of the bucket 32 and pointing toward the front of the work vehicle 10.

Because FIG. 3 depicts the work vehicle 10 traveling on level terrain, the chassis vector 21 is perpendicular to the gravity vector 11. Two separate orientations of the bucket 32 are schematically depicted in FIG. 3. In one of these schematic representations of the orientation of the bucket 32 in FIG. 3, the bucket's level position (also known as the non-spill orientation) that prevents the contents of the bucket 32 from spilling out of the bucket 32 is being depicted. The schematic representation showing this non-spill orientation of the bucket 32 depicts the bucket 32 with the bucket vector 31 oriented perpendicular to the gravity vector 11 when the chassis 20 is traversing across level terrain. Thus, as shown in the vector diagram portion of FIG. 3, the so-called chassis angle $\Theta$ that is subtended between the chassis vector 21 and the gravity vector 11 equals 90°, and the bucket angle $\alpha$ that is subtended between the bucket vector 31 and the gravity vector 11 also equals 90°. Accordingly, when each of the chassis vector 21 and the bucket vector 31 is oriented at a 90° angle from the gravity vector 11, then the chassis 20 is negotiating level terrain and the bucket 32 is deemed to be in the non-spill orientation that is shown for example in right-most depiction of the bucket in FIG. 3.

As noted above, in FIG. 3 the work vehicle 10 is schematically represented to be traveling on the driving surface 34 such that the chassis vector 21 is perpendicular to the gravity vector 11 and thus the work vehicle 10 is traveling along level terrain. In a second one of the schematic representations of the orientation of the bucket 32 in FIG. 3, the bucket 32 is shown tipping forward (also known as the forward-spill orientation) that allows the contents of the bucket 32 of spill out of the front end of the bucket 32. As shown in FIG. 3, when the chassis 20 is traversing across level terrain, the schematic representation of this forward-spill orientation of the bucket 32 depicts the bucket 32 with the bucket vector 31 subtending the bucket angle $\alpha$ at an acute angle with respect to the gravity vector 11. Accordingly, when the chassis 20 is negotiating level terrain and the bucket 32 is deemed to be in the forward-spill orientation that is shown for example in FIG. 3, while the chassis vector 21 is oriented at a 90° angle from the gravity vector 11, the bucket angle $\alpha$ defined between the bucket vector 31 and the gravity vector 11 is an acute angle.

Additionally, in several embodiments, the controller 102 may be configured to store information associated with one or more pre-defined position settings for the loader arm(s) 36 and/or the implement 32. Moreover, one or more pre-defined position settings may be stored for the loader arm(s) 36 and the implement 32. For example, a first loader position setting at which the forward pivot point 42 is located at a first height from the vehicle's driving surface 34 when the chassis 20 is negotiating a level terrain and a first implement position setting of the second attachment location 58 when the implement 32 is located at a given angular position or orientation relative to the vehicle's level driving surface 34 such that the bucket 32 for example resides in the non-spill orientation that prevents spillage of the contents from within the bucket 32. In such embodiments, the various pre-defined position settings stored within the controller's memory 106 may correspond to pre-programmed factory settings and/or operator defined position settings. For instance, as will be described below, the operator may provide a suitable input instructing the controller 102 to learn or record a position setting for the loader arm(s) 36 and/or the implement 32 based on the current position of such lift assembly component(s).

It should be appreciated that the current commands provided by the controller 102 to the various valves 108, 110, 116, 118 may be in response to inputs provided by the operator via one or more input devices 130. For example, one or more input devices 130 (e.g., the lift/tilt joystick(s) 25 shown in FIG. 1) may be provided within the cab 22 to allow the operator to provide operator inputs associated with controlling the position of the loader arm(s) 36 and the position of the implement 32 relative to the vehicle's driving surface 34 (e.g., by varying the current commands supplied to the lift and/or tilt valves 108, 110, 116, 118 based on operator-initiated changes in the position of the lift/tilt joystick(s) 25).

Alternatively, in accordance with one aspect of the present invention, the current commands provided to the various valves 108, 110, 116, 118 may be generated automatically based on a control algorithm implemented by the controller 102. In this regard, it should be appreciated that the work vehicle 10 also may include any other suitable input devices 130 for providing operator inputs to the controller 102. In accordance with one aspect of the present invention, one of these input devices 130 (e.g., a button or switch) may be provided to enable the operator to select a non-spill orientation of the implement 32 whereby as the work vehicle 10 negotiates varying terrain that causes changes in the chassis vector 21 and the bucket vector 31, the bucket 32 will undergo adjustments that maintain the bucket 32 in a non-spill orientation that prevents the contents of the bucket 32 from spilling out of the bucket 32. As will be described in detail below, the controller 102 may be configured to implement an algorithm for simultaneously moving the loader arm(s) 36 and/or the bucket 32 to so that the bucket 32 assumes a non-spill orientation as the work vehicle 10 negotiates varying terrain that causes changes in the chassis vector 21 and requires the controller 102 to effect adjustments to the bucket vector 31. In such instance, when the operator uses a dedicated one of the input devices 130 that selects the non-spill orientation of the bucket 32, control commands may be automatically generated by the controller 102 via implementation of one of the control algorithms and subsequently transmitted to the lift valve(s) 108, 110 and/or the tilt valve(s) 116, 118 to provide for control of the velocity and/or the position of the loader arm(s) 36 and/or the bucket 32 as such component(s) is/are moved to the maintain the bucket 32 in the non-spill orientation.

Moreover, as shown in FIG. 2, the controller 102 also may be communicatively coupled to one or more position sensors 132 for monitoring the position(s) and/or orientation(s) of the loader arm(s) 36 and/or the bucket 32. In several embodiments, the position sensor(s) 132 may correspond to one or more angle sensors (e.g., a rotary or shaft encoder(s) or any other suitable angle transducer) configured to monitor the angle or orientation of the loader arm(s) 36 and/or the bucket 32 relative to one or more reference points. For instance, in one embodiment, an angle sensor(s) may be positioned at the forward pivot point 42 (FIG. 1) to allow the position of the bucket vector 31 relative to the loader arm(s) 36 to be monitored. Similarly, an angle sensor(s) may be positioned at the rear pivot point 46 to allow the angle of the loader arm(s) 36 relative to a given reference point on the work vehicle 10 to be monitored. In addition to such angle sensor(s), or as an alternative thereto, one or more secondary angle sensors (e.g., a gyroscope, inertial sensor, etc.) may be mounted to the loader arm(s) 36 and/or the bucket 32 to allow the orientation of such component(s) relative to the vehicle's driving surface 34 to be monitored.

In other embodiments, the position sensor(s) 132 may correspond to any other suitable sensor(s) that is configured to provide a measurement signal associated with the position and/or orientation of the loader arm(s) 36 and/or the bucket 32. For instance, the position sensor(s) 132 may correspond to one or more linear position sensors and/or encoders associated with and/or coupled to the piston rod(s) or other movable components of the cylinders 48, 50 in order to monitor the travel distance of such components, thereby allowing for the position of the loader arm(s) 36 and/or the implement 32 to be calculated. Alternatively, the position sensor(s) 132 may correspond to one or more non-contact sensors, such as one or more proximity sensors, configured to monitor the change in position of such movable components of the cylinders 48, 50. In another embodiment, the position sensor(s) 132 may correspond to one or more flow sensors configured to monitor the fluid into and/or out of each cylinder 48, 50, thereby providing an indication of the degree of actuation of such cylinders 48, 50 and, thus, the location of the corresponding loader arm(s) 36 and/or implement 32. In a further embodiment, the position sensor(s) 132 may correspond to a transmitter(s) configured to be coupled to a portion of one or both of the loader arm(s) 36 and/or the bucket 32 that transmits a signal indicative of the height/position and/or orientation of the loader arms/bucket 36, 32 to a receiver disposed at another location on the vehicle 10.

It should be appreciated that, although the various sensor types were described above individually, the work vehicle 10 may be equipped with any combination of position sensors 132 and/or any associated sensors that allow for the position and/or orientation of the loader arm(s) 36 and/or the bucket 32 to be accurately monitored. For instance, in one embodiment, the work vehicle 10 may include both a first set of position sensors 132 (e.g., angle sensors) associated with the pins located at the pivot joints defined at the forward and rear pivot points 42, 46 for monitoring the relative angular positions of the loader arm(s) 36 and the bucket 32 and a second set of position sensors 132 (e.g., a linear position sensor(s), flow sensor(s), etc.) associated with the lift and tilt cylinders 48, 50 for monitoring the actuation of such cylinders 48, 50.

Moreover, it should be appreciated that the controller 102 may be coupled to various other sensors for monitoring one or more other operating parameters of the work vehicle 10. For instance, as shown in FIG. 2, the controller may be coupled to one or more pressure sensors 136 for monitoring the hydraulic pressure supplied within the lift and/or tilt cylinders 48, 50. In such an embodiment, the pressure sensor(s) 136 may, for example, allow the controller 102 to monitor the pressure of the hydraulic fluid supplied to both rod and cap ends 112, 114, 120, 112 of each of the various hydraulic cylinders 48, 50 of the lift assembly 30. Additionally, as shown in FIG. 2, the controller 102 may also be coupled to one or more temperature sensors 138 for monitoring the temperature of the hydraulic fluid within the system 100.

In accordance with one aspect of the present invention, a gravity sensor can be provided to determine and monitor the gravity vector 11 along which the force of gravity is acting upon the chassis 20 of the work vehicle 10. As schematically shown in FIG. 2 for example, a gravity sensor 134 is connected in communication with the controller 102 and configured to provide signals to the controller 102 indicative of the orientation of the gravity vector 11. Suitable gravity sensors 134 include inertial sensors, and examples are available from Advanced Navigation of New South Wales Australia, with sales office in Fort Worth, Tex.; CH Robotics of Payson, Utah; And LORD of Cary, N.C.

Specifically in accordance with one aspect of the present invention, as schematically shown in FIG. 2 for example, desirably more than one vector sensor 139 is provided to generate signals transmitted to the controller 102 indicative of the orientation of the chassis 20 and the bucket 32 relative to the gravity vector 11 regardless of the terrain of the driving surface 34 of the work vehicle 10 at any given moment. Accordingly, one of the vector sensors 139 is a chassis sensor that determines and monitors the chassis vector 21 along which the chassis 20 is negotiating the terrain of the driving surface 34 of the work vehicle 10 at any given moment and thus indicates the spatial orientation of the work vehicle 10 relative to the gravitational force acting on the vehicle 10. A still further one of the vector sensors 139 is a bucket sensor that determines and monitors the bucket vector 31 and provides to the controller 102 signals indicative of the orientation of the bucket vector 31.

Figure 4:
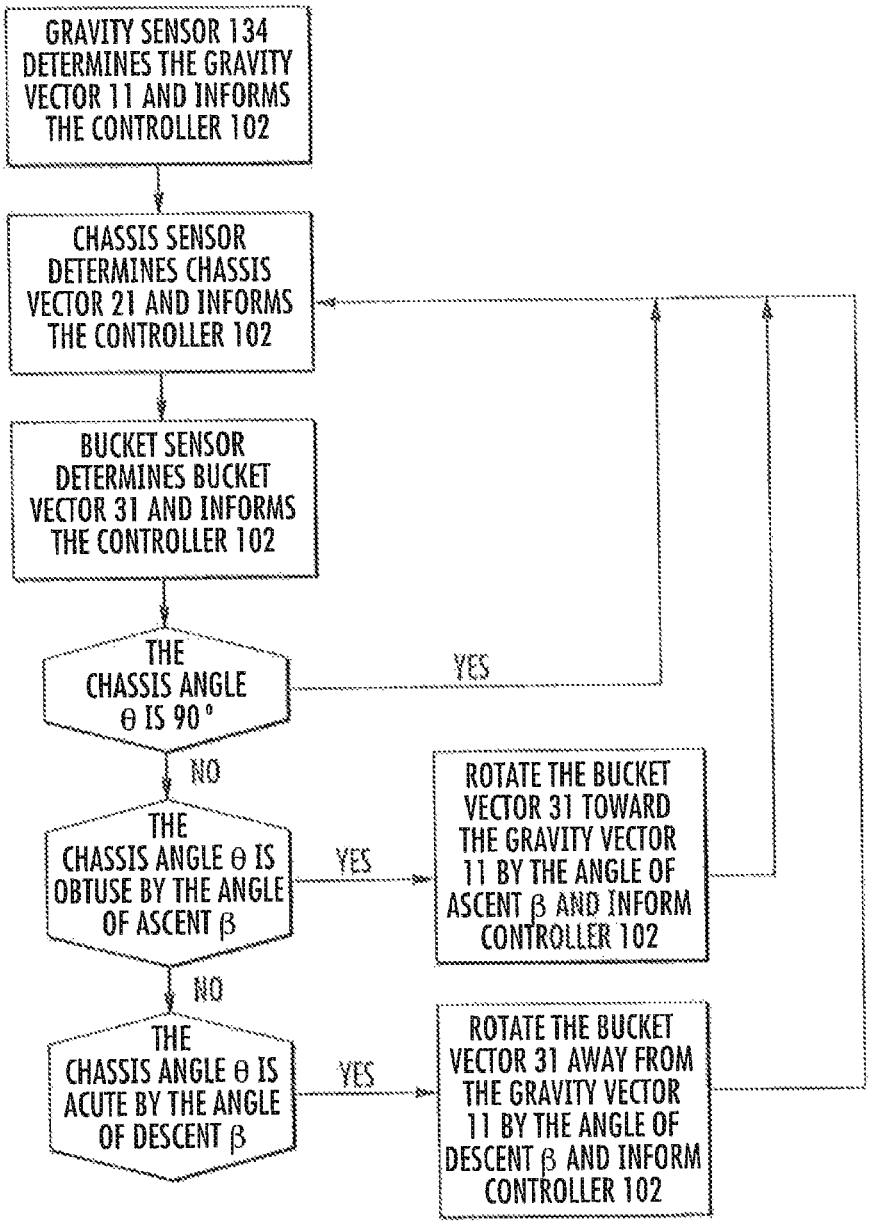
FIG. 4 schematically represents a flowchart for a process of controlling the level of the bucket in the non-spill orientation during travel of the work vehicle over terrain disposed at varying orientations relative to the gravity vector.

FIG. 4 schematically represents a flowchart for a process of controlling the level of the bucket 32 in the non-spill orientation during travel of the work vehicle 10 and its chassis 20 over terrain disposed at varying orientations relative to the gravity vector 11. The control method schematically illustrated in FIG. 4 begins once the bucket 32 has acquired its contents and assumed the non-spill position of the bucket 32 shown in FIG. 3. When the bucket 32 assumes the non-spill orientation, the gravity sensor 134 and the vector sensors 139 accordingly will be signaling the controller 102.

Referring to FIG. 4, the gravity sensor determines the orientation of the gravity vector 11 and accordingly signals the controller 102. At the same time, the chassis sensor determines the orientation of the chassis vector 21 and accordingly signals the controller 102 while the bucket sensor determines the orientation of the bucket vector 31 and accordingly signals the controller 102. The controller 102 uses these three signals to determine the relative orientations of the gravity vector 11, the chassis vector 21 and the bucket vector 31. From these relative orientations of these three vectors, 11, 21, 31, the controller 102 determines the chassis angle Θ that is subtended between the chassis vector 21 and the gravity vector 11. If as shown schematically in FIG. 3 the chassis angle Θ equals 90°, then the work vehicle 10 is traveling on level ground and the bucket vector 31 is assumed to have retained its initial condition and thus remains parallel to the chassis vector 21. Accordingly, there is not any required adjustment of the orientation of the bucket 32 in order to maintain the bucket 32 in the non-spill orientation. This same methodology can be followed for any initial condition of the bucket vector 31, but the non-spill orientation as the initial condition has been chosen for the sake of illustration.

Figure 5:
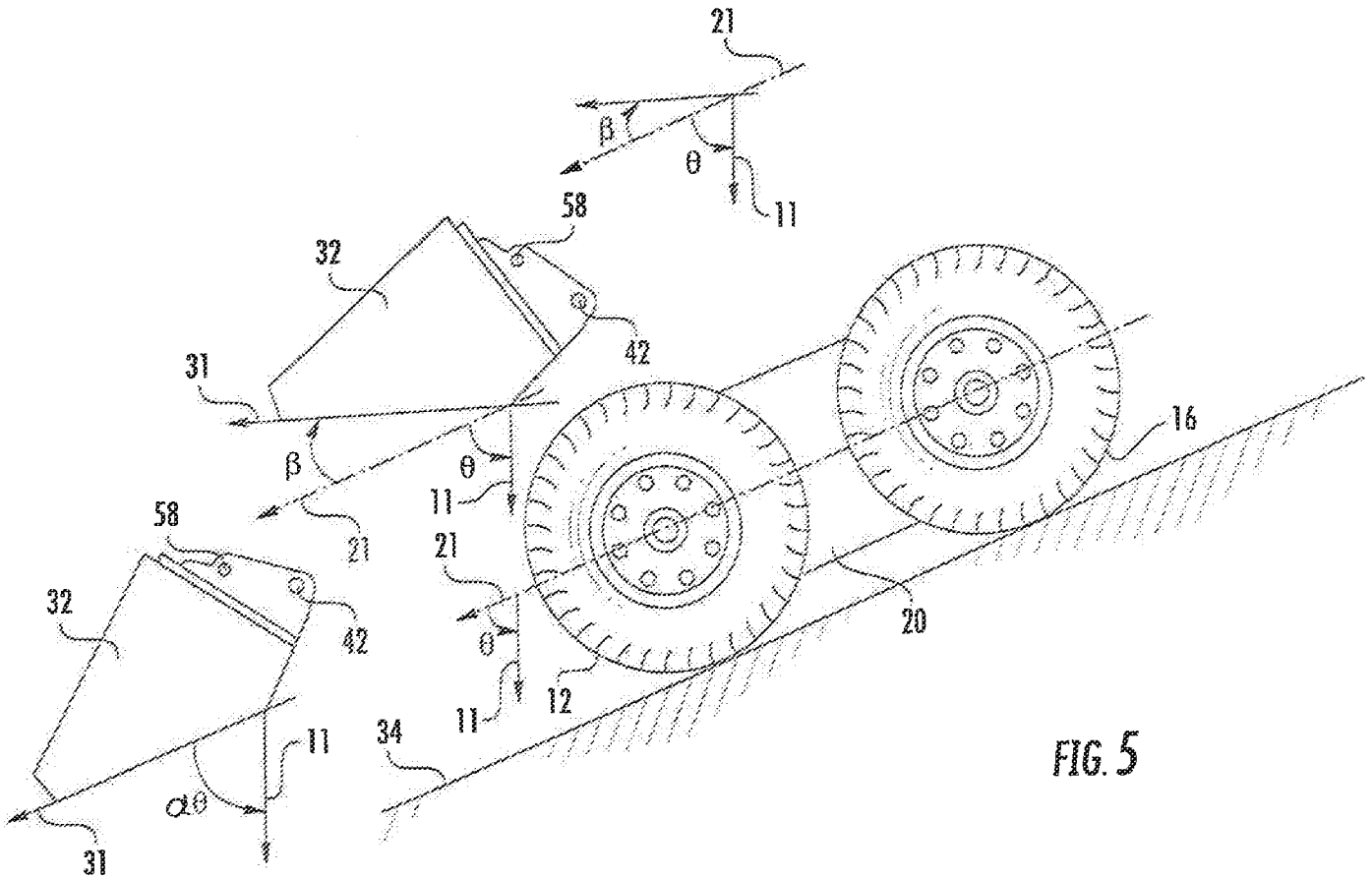
FIG. 5 schematically illustrates representations of the relative relationships between the orientation of the bucket and the orientation of the chassis relative to the gravity vector when the work vehicle has transitioned from level terrain as shown in FIG. 3 to descending terrain disposed at an angle 1 below the horizontal terrain of FIG. 3.

FIG. 5 illustrates a schematic representation of the relative relationships between the level of the bucket 32 and the level of the chassis 20 relative to the gravity vector 11 when the work vehicle 10 has transitioned from level terrain as shown in FIG. 3 to descending terrain wherein the chassis vector 21 is disposed at a deflation angle β below the horizontal terrain of FIG. 3. The left-most depiction of the bucket 32 from the viewer's perspective in FIG. 5 illustrates how the bucket 32 would be positioned in the forward-spill orientation without any adjustment of the orientation of the bucket 32 to account for the transition by the chassis 20 to a descending terrain from a level terrain in which the bucket 32 had been held in a non-spill orientation.

As schematically shown in FIG. 5, when the work vehicle 10 and its chassis 20 is in the descending mode, the chassis angle Θ subtended between the chassis vector 21 and the gravity vector 11 will be an acute angle, i.e., less than 90°. The chassis vector 21 is likewise disposed at the acute angle having a magnitude that is less than 90° by the magnitude of the deviation angle β, which in the view shown in FIG. 5 is the angle of descent from level terrain when the work vehicle 10 is in the descending mode. The angle of descent 1 is also considered to be the deviation angle β, which defines the magnitude of the angular deviation from the 90° chassis angle Θ that determines travel along level terrain by the chassis 20. The right-most depiction of the bucket 32 from the viewer's perspective in FIG. 5 illustrates how the bucket 32 would be positioned in the non-spill orientation after an adjustment of the orientation of the bucket 32 to account for the transition by the chassis 20 to a descending terrain from a level terrain in which the bucket 32 had been held in a non-spill orientation.

Referring to FIG. 4, when the chassis 20 is negotiating a descending terrain as shown in FIG. 5, the gravity sensor 134 determines the orientation of the gravity vector 11 and accordingly signals the controller 102. At the same time, the chassis sensor 139 (FIG. 2) determines the orientation of the chassis vector 21 and accordingly signals the controller 102 while the bucket sensor 139 (FIG. 2) determines the orientation of the bucket vector 31 and accordingly signals the controller 102. The controller 102 uses these three signals to determine the relative orientations of the gravity vector 11, the chassis vector 21 and the bucket vector 31. From these relative orientations of these three vectors, the controller 102 determines the chassis angle 9 that is subtended between the chassis vector 21 and the gravity vector 11. If as shown schematically in FIG. 5, the chassis angle Θ is an acute angle that is less than 90° by the amount of a descent angle β, then the chassis 20 of the work vehicle 10 is traveling on a descending terrain and the chassis vector 21 will be disposed below the level terrain vector by a magnitude equal to the descent angle β. Thus, when the chassis 20 is negotiating a descending terrain, if the bucket vector 31 of the bucket 32 is to remain perpendicular to (at 90° to) the gravity vector 11 and thus the bucket 32 is to remain oriented in the no-spill orientation, then the controller 102 must adjust the orientation of the bucket 32 such that the bucket vector 31 becomes adjusted by moving away from the gravity vector 11 by the magnitude of the descent angle β. Accordingly, as shown schematically in FIG. 4, the controller 102 sends signals for pivoting the bucket 32 in a manner that effects rotation of the bucket vector 31 by an angle β away from the gravity vector 11. In one embodiment, this can be accomplished by the controller 102 sending appropriate signals to the tilt valves 116, 118 and/or to the lift valves 108, 110. Thus, the control system 100 can be said to be configured to control the orientation of the bucket 32 so that the deviation of the bucket vector 31 from the gravity vector 11 (the bucket angle α) follows the deviation of the chassis vector 21 from the gravity vector 11 (the chassis angle Θ).

Figure 6:
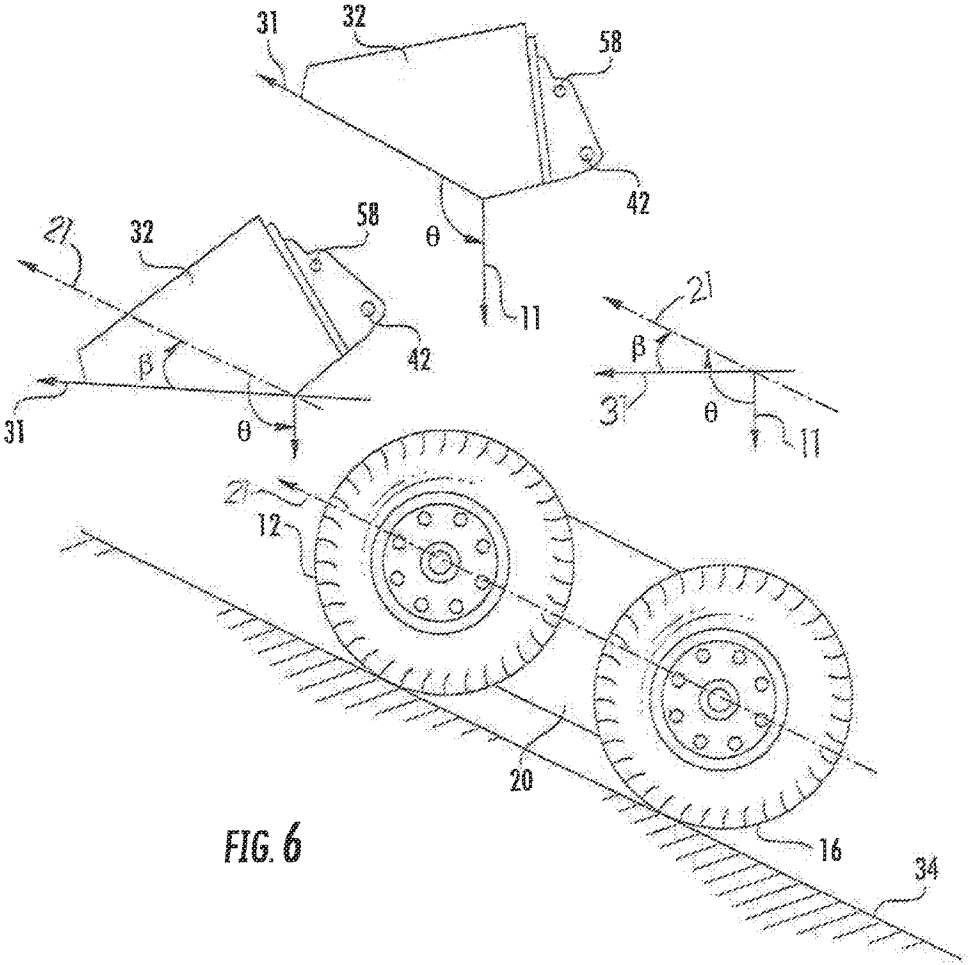
FIG. 6 schematically illustrates representations of the relative relationships between the orientation of the bucket and the orientation of the chassis relative to the gravity vector when the work vehicle has transitioned from level terrain as shown in FIG. 3 to ascending elevated terrain disposed at an angle β above the horizontal terrain of FIG. 3.

FIG. 6 illustrates a schematic representation of the relative relationships between the level of the bucket 32 and the level of the chassis 20 relative to the gravity vector 11 when the work vehicle 10 has transitioned from level terrain as shown in FIG. 3 to ascending terrain wherein the chassis vector 21 is disposed at a deviation angle β above the horizontal terrain of FIG. 3. The right-most depiction of the bucket 32 from the viewer's perspective in FIG. 6 illustrates how the bucket 32 would be positioned in the backward-spill orientation without any adjustment of the orientation of the bucket 32 to account for the transition by the chassis 20 to an ascending terrain from a level terrain in which the bucket 32 had been held in a non-spill orientation.

As schematically shown in FIG. 6, when the work vehicle 10 and its chassis 20 is in the ascending mode, the chassis angle Θ subtended between the chassis vector 21 and the gravity vector 11 will be an obtuse angle, i.e., greater than 90°. The chassis vector 21 is likewise disposed at the obtuse angle having a magnitude that is greater than 90° by the magnitude of the ascent angle β, which is the angle of ascent from level terrain when the work vehicle 10 is in the ascending mode. The angle of ascent β is also considered to be the deviation angle β, which defines the magnitude of the angular deviation from the 90° chassis angle Θ that determines travel along level terrain by the chassis 20. The left-most depiction of the bucket 32 from the viewer's perspective in FIG. 6 illustrates how the bucket 32 would be positioned in the non-spill orientation after an adjustment of the orientation of the bucket 32 to account for the transition by the chassis 20 to an ascending terrain from a level terrain in which the bucket 32 had been held in a non-spill orientation.

Referring to FIG. 4, when the chassis 20 is negotiating an ascending terrain as shown in FIG. 6, the gravity sensor 134 determines the orientation of the gravity vector 11 and accordingly signals the controller 102. At the same time, the chassis sensor 139 (FIG. 2) determines the orientation of the chassis vector 21 and accordingly signals the controller 102 while the bucket sensor 139 (FIG. 2) determines the orientation of the bucket vector 31 and accordingly signals the controller 102. The controller 102 uses these three signals to determine the relative orientations of the gravity vector 11, the chassis vector 21 and the bucket vector 31. From these relative orientations of these three vectors, the controller 102 determines the chassis angle Θ that is subtended between the chassis vector 21 and the gravity vector 11. If as shown schematically in FIG. 6, the chassis angle Θ is an obtuse angle that is greater than 90° by the amount of an ascent angle β, then the chassis 20 of the work vehicle 10 is traveling on an ascending terrain and the chassis vector 21 will be disposed above the level terrain vector by a magnitude equal to the ascent angle β. Thus, when the chassis 20 is negotiating an ascending terrain, if the bucket vector 31 of the bucket 32 is to remain perpendicular to (at 90° to) the gravity vector 11 and thus the bucket 32 is to remain oriented in the non-spill orientation, then the controller 102 must adjust the orientation of the bucket 32 such that the bucket vector 31 becomes adjusted by moving toward the gravity vector 11 by the magnitude of the ascent angle β. Accordingly, as shown schematically in FIG. 4, the controller 102 sends signals for pivoting the bucket 32 in a manner that effects rotation of the bucket vector 31 by an angle β toward the gravity vector 11. In one embodiment, this can be accomplished by the controller 102 sending appropriate signals to the tilt valves 116, 118 and/or to the lift valves 108, 110. In this manner the control system 100 is configured to control the orientation of the bucket 32 so that the bucket vector's deviation from the gravity vector 11 (the bucket angle α) follows the chassis vector's deviation from the gravity vector 11 (the chassis angle Θ).

It should be appreciated that the frequency with which the methodology illustrated in FIG. 4 is carried out can be coordinated depending upon the velocity of the chassis vector 21. Thus, when the work vehicle 10 is traveling at faster speeds, it is necessary for the adjustments to the orientation of the bucket 32 to occur relatively more frequently than when the work vehicle 10 is traveling more slowly. The control system 100 desirably is configured to control the orientation of the bucket 32 so that the angle subtended between the bucket vector 31 and the gravity vector 11 does not deviate from 90 degrees by more than one degree over any length of time greater than one second. Other embodiments may not require such precision, and accordingly be engineered for example with valves 108, 110, 116, 118 that respond over longer time intervals but are more robust to move greater loads in the bucket 32 wherein the control system 100 desirably is configured to control the orientation of the bucket 32 so that the angle subtended between the bucket vector 31 and the gravity vector 11 does not deviate from 90 degrees by more than five degrees over any length of time greater than three seconds.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of maintaining during travel of the chassis of a work vehicle over varying terrain relative to a gravity vector that defines the direction of the gravitational pull on the chassis, a predefined non-spill orientation of a bucket that defines a bucket vector and that is pivotally carried by the chassis that defines a chassis vector that subtends a chassis angle relative to the gravity vector, the method comprising the steps of:

employing a gravity sensor to determine the gravity vector;

employing a chassis sensor that determines the chassis vector;

employing a bucket sensor that determines the bucket vector;

employing a controller to control the orientation of the bucket as defined by the bucket vector, employing the controller to receive from the sensors the determinations of the gravity vector and the chassis vector to determine a chassis angle; and employing the controller to use any deviation of the chassis angle from 90 degrees by a deviation angle to adjust the orientation of the bucket as defined by the bucket vector by the amount of the deviation angle.

2. The method of claim 1, wherein when the chassis angle is an acute angle the controller adjusts the orientation of the bucket so as to rotate the bucket vector away from the gravity vector by the deviation angle.

3. The method of claim 1, wherein when the chassis angle is an obtuse angle the controller adjusts the orientation of the bucket so as to rotate the bucket vector toward the gravity vector by the deviation angle.

4. The method of claim 1, wherein when the chassis angle is a right angle the controller does not adjust the orientation of the bucket.

5. The method of claim 1, further comprising the step of using a speed sensor to determine the speed of travel of the chassis.

6. The method of claim 5, wherein the steps of the method are repeated with a frequency that depends upon the speed determined by the speed sensor.

7. The method of claim 6, wherein the frequency with which the steps of the method are repeated is commensurate with the magnitude of the speed determined by the speed sensor.

8. The method of claim 7, wherein the greater the magnitude of the speed determined by the speed sensor the greater is the frequency with which the steps of the method are repeated.

9. A work vehicle, comprising:

a gravity sensor carried by the chassis and configured to measure a gravity vector that defines the direction in which the gravitational force acts on the chassis;

a chassis sensor carried by the chassis and configured to determine the orientation of a chassis vector relative to the gravity vector;

a bucket carried by the chassis and pivotally mounted with respect to the chassis and defining a bucket vector, a bucket sensor carried by the chassis and configured to determine the orientation of the bucket vector relative to the gravity vector;

a control system carried by the chassis and connected to the gravity sensor, the chassis sensor, and the bucket sensor, and wherein the control system controls adjustment of the orientation of the bucket according to signals received from the gravity sensor, the chassis sensor, and the bucket sensor.

10. The work vehicle of claim 9, wherein the control system is configured to use the signals received from the gravity sensor and the chassis sensor to determine a chassis angle that is subtended between the chassis vector and the gravity vector.

11. The work vehicle of claim 9, wherein the control system is configured to control the orientation of the bucket so that the bucket vector's deviation from the gravity vector follows the chassis vector's deviation from the gravity vector.

12. The work vehicle of claim 9, wherein the control system is configured to control the orientation of the bucket so that the angle subtended between the bucket vector and the gravity vector does not deviate from 90 degrees by more than one degree during any one second interval.

13. The work vehicle of claim 9, wherein the control system is configured to control the orientation of the bucket so that the angle subtended between the bucket vector and the gravity vector does not deviate from 90 degrees by more than five degrees during any three second interval.

14. The work vehicle of claim 9, wherein the gravity sensor is an inertial sensor.

15. The work vehicle of claim 9, wherein the bucket sensor is carried by the bucket.

* * * * *